United States Patent [19]

Beier

[11] Patent Number: 4,678,878

[45] Date of Patent: Jul. 7, 1987

[54] GAS PRESSURE CIRCUIT BREAKER

[75] Inventor: Helmut Beier, Berlin, Fed. Rep. of Germany

[73] Assignee: Siemens Aktiengesellschaft, Munich, Fed. Rep. of Germany

[21] Appl. No.: 924,632

[22] Filed: Oct. 29, 1986

[30] Foreign Application Priority Data

Oct. 29, 1985 [DE] Fed. Rep. of Germany ..... 3538955

[51] Int. Cl.[4] ..... H01H 33/88

[52] U.S. Cl. ..... 200/148 A; 200/148 R

[58] Field of Search ..... 200/148 A, 148 R

[56] References Cited

FOREIGN PATENT DOCUMENTS 3430306 1/1985 Fed. Rep. of Germany ... 200/148 A

*Primary Examiner*—Robert S. Macon

*Attorney, Agent, or Firm*—Kenyon & Kenyon

[57] ABSTRACT

In a gas pressure circuit breaker with two fixed contacts an insulation tube is in the path of the quenching gas flow during circuit breaking. The insulation tube is grooved internally and externally. Openings for the quenching gas flow are formed by intersection of the sufficiently deep inner and outer grooves at crossings. There results a ribbed body of low material intensity, which nevertheless is resistant to bending and torsion. Under mechanical (static and dynamic) and thermal stress the insulation tube exhibits a long life. The arc applying stress on the inner surface weakens the rib structure of the insulation tube comparatively little. The surface toward the arc has no web connections in the axial direction. Due to the resulting layering of insulating material and insulating or quenching gas, the resistance of the circuitbreaker to surface leakage current is increased.

9 Claims, 2 Drawing Figures

GAS PRESSURE CIRCUIT BREAKER

BACKGROUND OF THE INVENTION

The present invention relates to a gas pressure circuit breaker having a break gap formed by two fixed contacts and having an insulation tube surrounding the gap at least at times and further having sheath-side passage openings for the distribution of a quenching gas flowing into the break gap.

Such a gas pressure circuit breaker is known, for instance, from DE-PS No. 26 47 643. In this circuit breaker the break gap is surrounded, in the course of the breaking movement, by a thin-walled insulation tube, whose sheath-side passage openings for the quenching gas are formed, for example, by rectangular slits extending in azimuthal direction to the insulation tube, the slits being separated by webs extending in the axial and azimuthal direction. The webs are under the thermal stress of an arc drawn during breaking, from the interior of the insulation tube, and even when arc-resistant materials, such as PTFE, are used, they are mechanically weakened by the inevitable burnoff, so that the stability of the insulation tube may be reduced.

SUMMARY OF THE INVENTION

It is an object of the present invention in a gas pressure circuit breaker of the above mentioned type to increase the mechanical stability of the insulation tube at comparable cost of material and to improve the electric strength of the tube wall toward the arc.

The above and other objects of the invention are achieved by a gas pressure circuit breaker comprising a break gap formed by two fixed contacts and having an insulation tube surrounding the gap at least at times and having sheath side openings for the distribution of a quenching gas flowing into the break gap, the insulation tube being internally and externally grooved, the inner and outer grooves crossing and having a depth such that they penetrate each other at the crossings, forming said openings.

The invention provides a ribbed body relatively resistant to bending and torsion having ribs arranged essentially in two different cylinder planes. This ribbed body may have an equal amount of material as a thin-walled tube. By this construction, the load capacity and hence the life of the insulation tube under static and dynamic stresses, in particular under stress by switching movement and gas pressure, is increased. Also, the life can be lengthened under thermal stress of the burning arc, as material reduction caused by normal burnoff does not diminish the stability of the ribbed body. The stability is preserved because only the inner surfaces nearest the arc are thermally stressed, not the entire insulation tube. By the design according to the invention, the electrical strength is increased because the insulating material and the insulating or quenching gas alternate several times in the axial direction.

In a preferred embodiment of the invention, several inner grooves extending in the azimuthal direction in different radial planes are provided. If, as in a further form of the invention, the inner groove is formed as a peripheral annular groove in a radial plane, the quenching gas stream will not fan out at any point of the circumference after entrance into the break gap; instead, it is concentrated in disk form. Thus the depth of penetration of the tubulent gas masses into the break gap is increased, resulting in better cooling of the arc drawn in the break gap. Besides, at the surface toward the arc no web connections will result in the axial direction which after extinction of the arc could increase the conductivity of the insulating material; thereby the surface leakage current strength is improved in the invention.

According to another variant of the invention where the inner grooves are evenly distributed over the length of the insulation tube, a uniform blowing jet on the arc over the break gap is achieved.

An advantageous embodiment of the invention has several axially extending outer grooves, preferably continuous in the axial direction, whereby a simple manufacture of the insulation tube can be obtained. If, as is provided in a further preferred embodiment of the invention, the outer grooves are evenly distributed over the circumference, the openings can be arranged uniformly on the wall of the insulation tube in the axial as well as in the azimuthal direction. This results in a turbulent gas flow uniformly developed in the blow region, cooling the arc.

From DE-PS No. 31 45 391, a gas pressure circuit breaker having an insulation body for guiding the gas stream is indeed known, which surrounds the break gap with internal fins directed radially thereto and which is mechanically stable. But this insulation body is not tubular and does not have external grooves crossing the internal grooves. The insulation body provided in this known circuit breaker is also costly with respect to material.

As a rule, it is made by sintering and hence as a special component with a configuration, so that the use of inexpensive semi-finished products is rendered difficult.

According to an especially advantageous embodiment of the invention, the approach cross-section formed by all openings is greater than the exit cross-section formed by the two nozzle type contacts. The approach cross-section is preferably 1.3 to 1.7 times the exit cross-section. By this measure the quenching conditions during a cutout are influenced favorably.

BRIEF DESCRIPTION OF THE DRAWINGS

The invention will be explained in greater detail in the following detailed description with reference to the drawings, in which.

DETAILED DESCRIPTION

Figure 1:
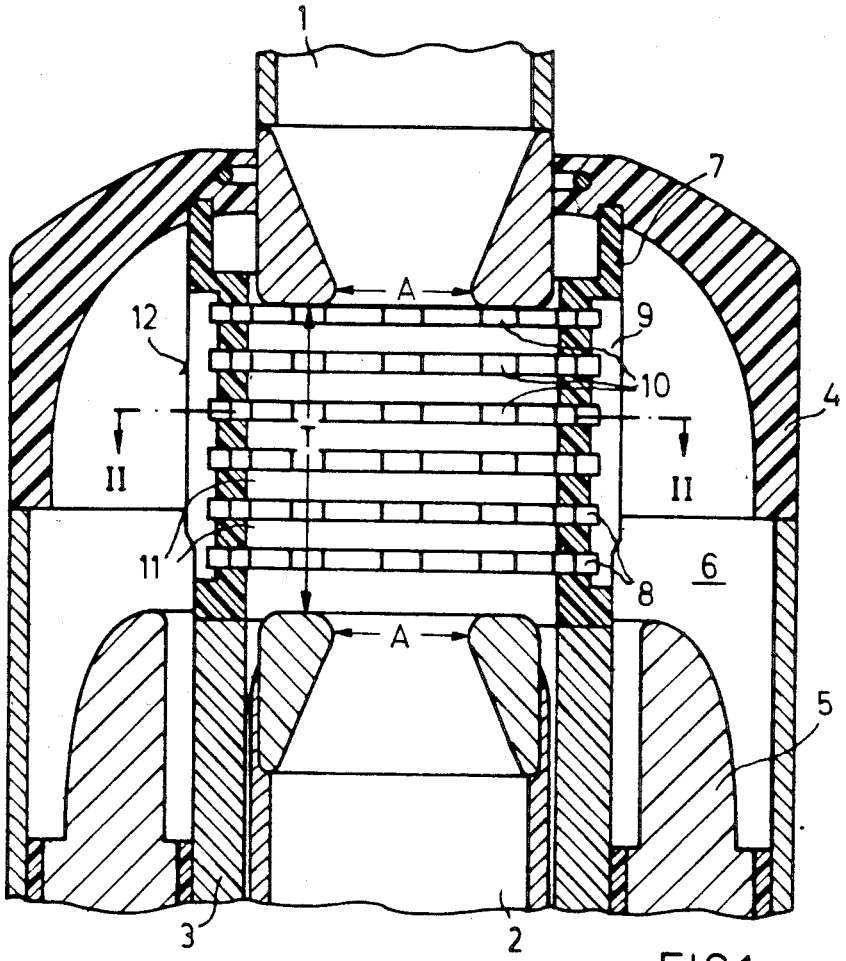
FIG. 1 shows schematically in a section the parts of a gas pressure circuit breaker necessary for comprehension of the invention.

The gas pressure circuit breaker shown in FIG. 1 comprises two axis-congruent contacts 1, 2, which by their end faces define a break gap T and which for the removal of quenching gas are nozzle-shaped with an exit cross-section totaling double a cross-sectional area A. In the circuit-closing state, the contacts 1 and 2 are bridged for electric conduction by a bridging contact 3 which is moved axially by a drive means not shown in detail. The drive means controls in the same direction a blast cylinder 4, which cooperates with a fixed piston 5.

Gas contained in a piston-cylinder space 6 between the piston 5 and the blast cylinder 4, in particular, sulfur hexafluoride, is compressed in the course of the circuit-opening action by the movement of the blast cylinder 4 and is conveyed into the break gap T via an insulation tube 7 which is firmly connected with the bridging contact 3 and the blast cylinder 4. In the circuit-closing position, the insulation tube 7 is outside the break gap T. In the course of the circuit-opening action it moves off the contact 1 toward contact 2 and surrounds the break gap T.

The insulation tube 7 is grooved internally and externally. It has peripheral inner grooves 8, uniformly distributed over the length of the insulation tube 7, and several axial outer grooves 9. The latter are continuous and evenly distributed over the circumference of the insulation tube. The inner grooves 8 and the outer grooves 9 cross and have a depth such that they penetrate each other at the crossings, thereby forming openings 10. Through these openings 10, the gas compressed in the piston-cylinder space 6 flows, in the course of the circuit-opening movement, against an arc drawn between the contacts 1 and 2 or 3, which is thereby cooled. An inner surface formed by the inner grooves 8 and inner groove webs 11 is thermally stressed by the drawn arc, yet the supporting function and the electric strength can be maintained relatively long. Outer groove webs 12 bounded by the outer grooves 9 are not influenced by the arc and therefore are able to maintain their supporting function even under comparatively strong arc action on the inner surface.

The sum of all openings 10 forms the approach cross-section of the quenching gas into the break gap. The approach cross-section is 1.3 times the exit cross-section 2A. By this measure a further increase of the blast pressure after clearing of the openings 10 nearest the bridging contact 3 is achieved, so that the quenching gas flow is intensified and, due to the delayed blast pressure reduction, its duration is lenghtened. But at the same time also the break gap is quickly deionized by means of the quenching gas flowing out through the exit cross-section 2A, so that prompt electrical restabilization of the break gap is achieved.

Figure 2:
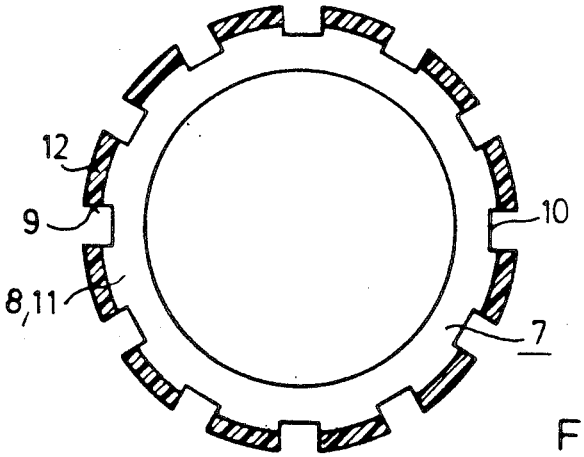
FIG. 2 is a section along the sectional line II—II in FIG. 1.

It is evident from the section of FIG. 2 that an arc burning inside the insulation tube 7 is largely kept away from the outer groove webs 12 by the inner groove webs 11 extending radially, so that a loss of mechanical stability can occur only after considerable burnoff in the region of the inner groove webs.

The insulation tube 7 provided in the invention is resistant to bending and torsion despite its comparately low cost of material. It thus withstands for a long life the mechanical (static and dynamic) and thermal stresses occurring in modern gas pressure power circuit breakers. By the design of the approach cross-section in relation to the exit cross-section 2A favorable quenching conditions are obtained.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A gas pressure circuit breaker comprising a break gap formed by two fixed contacts and having an insulation tube surrounding the gap at least at times and having sheath-side openings for the distribution of a quenching gas flowing into the break gap, the insulation tube being internally and externally grooved, the inner and outer grooves forming crossings and have a depth such that they penetrate each other at the crossings, thereby forming the openings.

2. The gas pressure circuit breaker recited in claim 1, wherein several inner grooves extend in an azimuthal direction in different radial planes.

3. The gas pressure circuit breaker recited in claim 2, wherein the inner grooves comprise peripheral annular grooves.

4. The gas pressure circuit breaker recited in claim 3 wherein the inner grooves are distributed uniformly over the length of the insulation tube.

5. The gas pressure circuit breaker recited in claim 1, wherein the outer grooves extend axially.

6. The gas pressure circuit breaker recited in claim 5, wherein the outer grooves are continuous in the axial direction.

7. The gas pressure circuit breaker recited in claim 5 wherein the outer grooves are distributed uniformly over the circumference.

8. The gas pressure circuit breaker recited in claim 1, wherein the fixed contacts are nozzle-shaped for the removal of the quenching gas and an approach cross-section formed by all openings is greater than an exit cross-section formed by the two nozzle-shaped contacts.

9. The gas pressure circuit breaker recited in claim 8, wherein the approach cross-section is 1.3 to 1.7 times the exit cross-section.

* * * * *